US005285815A

United States Patent [19]

Henry et al.

[11] Patent Number: 5,285,815

[45] Date of Patent: Feb. 15, 1994

[54] BEVERAGE DISPENSING VALVE HAVING QUICK DISCONNECT MOUNTING

[75] Inventors: Paul J. Henry, Anoka; Joseph W. Kieffer, Maple Grove; W. Gregory Mertes, Andover, all of Minn.

[73] Assignee: The Cornelius Company, Anoka, Minn.

[21] Appl. No.: 795,568

[22] Filed: Nov. 21, 1991

[51] Int. Cl.[5] ..... F17D 1/08

[52] U.S. Cl. ..... 137/595; 137/614.06; 251/149.9; 222/129.1

[58] Field of Search ..... 251/149.9; 137/595, 137/614.06, 884; 222/129.1

[56] References Cited

U.S. PATENT DOCUMENTS

| | | | |
|---|---|---|---|
| 2,399,515 | 4/1946 | Snyder | 137/595 |
| 2,399,516 | 4/1946 | Snyder | 137/595 X |
| 2,399,525 | 4/1946 | Waag | 137/595 |
| 3,540,476 | 11/1970 | Fuerst | 251/149.9 X |
| 4,496,079 | 1/1985 | Verley | 251/149.9 X |
| 4,497,343 | 2/1985 | Brown et al. | 251/149.9 X |
| 4,936,488 | 6/1990 | Austin | 251/149.9 X |
| 4,982,734 | 1/1991 | Green et al. | 137/614.06 X |

*Primary Examiner*—Andres Kashnikow
*Assistant Examiner*—Anthoula Pomrening
*Attorney, Agent, or Firm*—Sten Erik Hakanson

[57] ABSTRACT

A post-mix beverage dispensing valve is shown having a quick disconnect mounting and easily detachable valve cover housing and valve actuating lever. The quick disconnect includes a body having a pair of parallel shafts extending therethrough. A pair of lock plates are secured on each end of the shafts. The locking plates each include a pair of locking tabs that cooperate with similarly sized locking pockets or areas on the valve main body. The valve also includes modular brix/flow control components to provide for quick adapting of the valve over a wide range of desired flow and/or brix parameters. An adjustable nozzle is shown for adjusting the flow rate of beverage there from with respect to the operating flow rate.

11 Claims, 11 Drawing Sheets

10
80
152
150
44
156
43
12
12
130
55
60

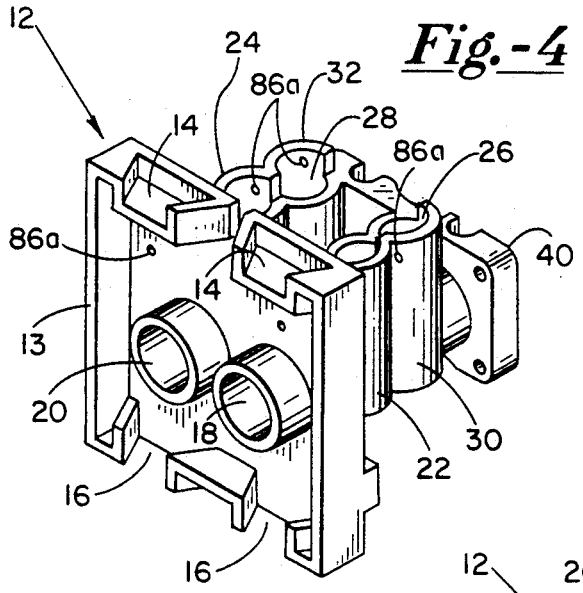
Fig.-4
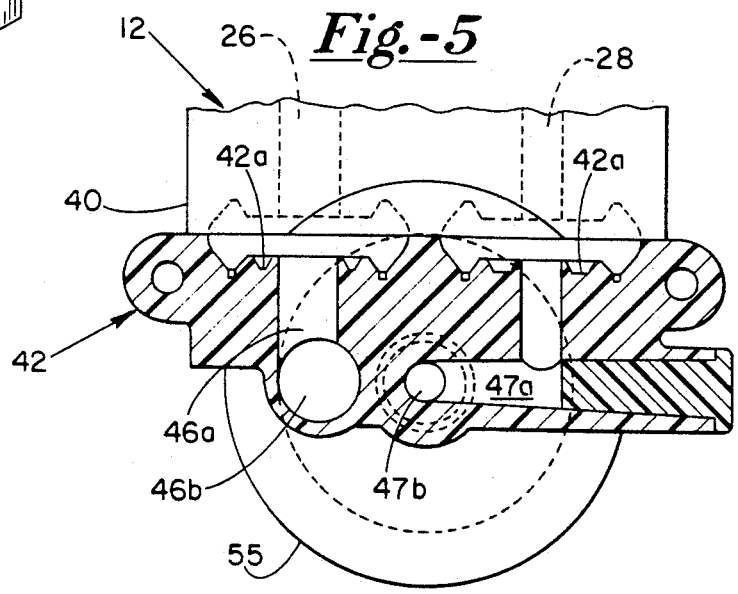
Fig.-5
Fig.-6
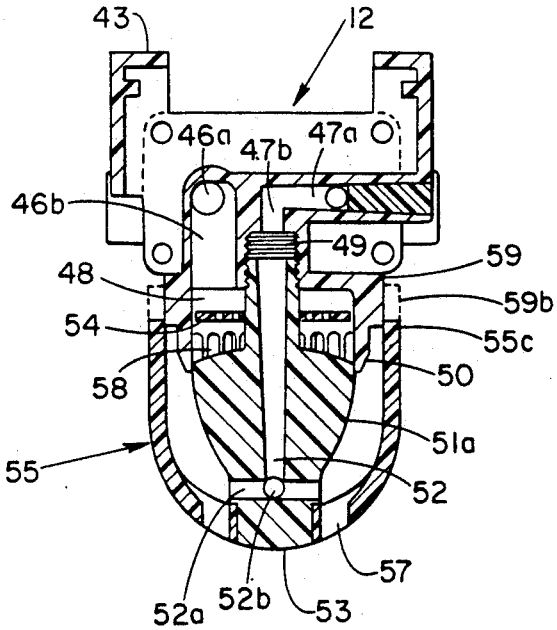

BEVERAGE DISPENSING VALVE HAVING QUICK DISCONNECT MOUNTING

BACKGROUND OF THE INVENTION

1. Field of the Invention:

The present invention relates generally to beverage dispensing valves and, in particular, to post-mix beverage dispensing valves.

2. Background:

Post-mix beverage dispensing valves are well known in the prior art and provide for the simultaneous mixing of a water and syrup component for the production of a beverage. Standard flow rates for such valves are typically 1½ to 3 ounces per second; however, flow rates of 4½ to 6 ounces are now also becoming desirable. In addition, it is known that the desired brix ratio can vary depending on the type of drink being dispensed. Although prior art valves can be set up to provide a particular flow rate at a desired mixing ratio, such prior art valves are not easily and quickly adjustable to provide for substantially different flow rates and/or mix ratio requirements.

As post-mix valves are required to provide an accurate brix at a desired flow rate, and to maintain such precision it is well understood in the industry that such valves periodically need cleaning, adjusting and other maintenance. Accordingly, it would be desirable to have a post-mix valve wherein the internal components are quickly and easily accessible, adjustable and repairable.

SUMMARY OF THE INVENTION

The present invention comprises a post-mix beverage dispensing valve with interchangeable flow control modules for providing quick change of brix and/or flow control. In addition, the valve of the present invention provides for an improved quick disconnect mounting, an easily removeable actuating lever, and for an easily removed valve housing.

In particular, the present invention includes a valve body adapted for releasably retaining a plurality of flow/brix control units designed to mate with a standard valve body portion. A U-shaped pin is insertable into the valve body to provide for releasably engaging of the flow or brix control means thereto.

An adjustable nozzle is shown for optimizing flow over a range of flow rates. The valve of the present invention provides for flow rates over a range of from generally one and one-half and up to six ounces per second. Such change in rates is accomplished by the use of various flow/brix controls, as described above, which controls are set or settable to different flow rates. The nozzle is adjustable to provide for an even flow and one that minimizes loss of beverage carbonation during dispensing. The nozzle includes a central flow piece having a frusto-conical outer water flow surface and an interior syrup flow channel. The central flow piece is threadably engageable with a banjo body valve portion. The banjo body portion includes a plurality of regularly spaced teeth extending there from around a circular perimeter, the center of which being where the central flow piece is threadably engageable with the banjo body portion. The plurality of teeth cooperate with an outer perimeter edge of the central flow portion when threadably engaged with the banjo body so as to define a plurality of water release orifices. A flat diffuser plate or washer includes a plurality of small orifices evenly distributed there through, and is held between the banjo body portion and the central flow piece. A nozzle housing has an exterior wall defining a central cavity, and the wall defining a singular opening on one end and a plurality of beverage release orifices on an opposite end thereof. The nozzle housing is secured to the central nozzle flow portion wherein the flow portion is retained within the nozzle housing cavity.

In operation, while dispensing beverage, the outer nozzle housing is rotated thereby rotating the central nozzle portion. In this manner the central portion, by virtue of its threaded engagement with the banjo valve body, can be adjusted inwardly or outwardly with respect thereto. Thus, the size of the water release orifices can be varied, and hence the back pressure acting on the carbonated water. Without any back pressure, the carbonated water has a tendency to flow unevenly along a particular side of the nozzle central portion and not mix evenly and quickly with the syrup. Thus, the water release orifices are adjusted in size for the particular flow rate so that they are of a size just small enough to create sufficient back pressure wherein the water flows evenly around and down the exterior surface of the central portion. In addition, it is desirable not to make the water orifices so small as to cause the carbonated water to spray outwardly there from, which action will result in an undesirable loss of carbonation and less effective mixing of the syrup therewith. In a properly adjusted nozzle, a gradual deceleration of the flow of the carbonated water occurs as it flows along the nozzle central portion. The water then mixes with syrup exiting from the syrup release orifices at the bottom of the nozzle central portion so that the loss of carbonation from the carbonated water is in this way also minimized. It can be appreciated that the nozzle housing serves to enable adjustment of the nozzle while preventing operator contact with the beverage dispensing there from and with the nozzle central portion.

The present invention also includes an improved quick disconnect. The quick disconnect includes a body having a pair of parallel shafts extending therethrough. A pair of lock plates are secured on each end of the shafts. The locking plates each include a pair of locking tabs that cooperate with similarly sized locking pockets or areas on the valve main body. Each shaft includes a narrow diameter portion and appropriate O-rings to form barrel valves for separately controlling the flow of syrup and carbonated water. In operation, in a first locking position, the locking tabs of each plate cooperate with the pockets of the valve main body for locking engagement therewith. In this locking position, the barrel valves are open and permit the flow therethrough of the syrup and water. By moving the locking plates upwardly they simultaneously disengage with the valve main body and, by connection to the shafts of the barrel valves, close off the flow of water and syrup to the valve main body. This quick disconnect structure was found to reduce the number of parts found in prior art disconnects, to be more easily and quickly manually manipulated, and to provide for a positive locking, as well as simultaneous shut-off, of the syrup and water sources.

The actuating lever of the present invention is pivotally suspended from a pin secured to a snap connect lever support. The lever support includes a lip on one end and a live hinge opposite thereto. The valve lever disconnect cooperates with a hole positioned in a valve base portion of the present invention. In particular, the lever support lip first extends into the hole and is supported by a perimeter edge thereof. The lever support is then secured to the valve base by snapping engagement of the live hinge with an opposite perimeter edge of the valve base hole. The snap connect provides for a valve lever that can then be quickly and easily removed for cleaning and/or replacement.

The present invention further includes a valve housing including a main valve housing portion, a valve base and a front access cover. The main housing portion is first slideably engageable with the valve base, after which the front cover is slideably engageable with the main housing portion in a direction substantially transverse to the sliding engagement of the housing portion with the valve base. In addition, when the access cover is slideably engaged with the valve base, the access cover prevents the main housing portion from disengaging from the valve base. In this manner, the housing covering the internal working components of the present beverage valve can be removed quickly and easily to provide for access thereto.

DESCRIPTION OF THE DRAWINGS

A better understanding of the structure and the objects and advantages of the present invention can be had by reference to the following detailed description which refers to the following figures wherein:

FIG. 4 shows a rear perspective view of the main body portion.

FIG. 5 shows a top plan partial cross-sectional view along lines 5—5 of FIG. 6.

FIG. 6 shows a cross-sectional view along lines 6—6 of FIG. 3.

DETAILED DESCRIPTION

Figure 9:
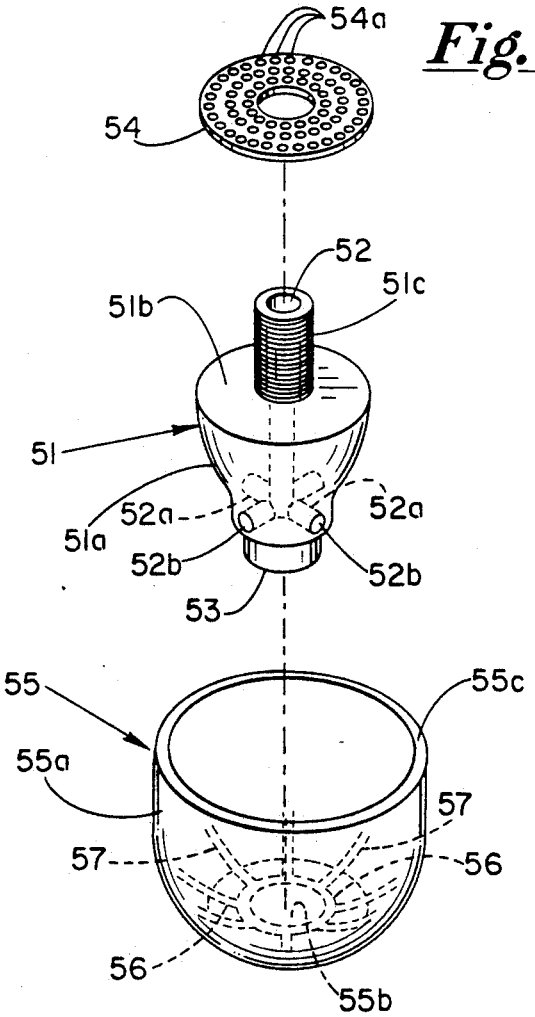
FIG. 9 shows an exploded view of the nozzle outer housing portion, nozzle inner central flow portion, and diffuser.

The post-mix beverage dispensing valve of the present invention is seen in the various figures, and referred to by the numeral 10. Referring to FIGS. 1–4, valve 10 has a valve main body portion 12. Valve portion 12 has a quick disconnect end 13 including a pair of upper trapezoidially shaped lock retaining pockets 14 and lower trapezoidially shaped lock retaining pocket areas 16, water inlet line 18 and a syrup inlet line 20. Inlet lines 18 and 20 extend through upright extending inlet tubes 22 and 24 respectively. Body portion 12 also includes a pair of outlet channels 26 and 28 extending, in part, through outlet tubes 30 and 32 respectively. Referring also to FIGS. 3–9, and 20, it can be seen that channels 26 and 28 communicate with a pair of vertically oriented banjo valves, 34 and 36 respectively, retained between a valve end portion 40 of main valve body 12 and banjo valve block 42. Block 42 also includes supports 43 for providing a screwable attachment thereto of a solenoid 44. Solenoid 44 includes an actuating arm **44*a* connected to stems 34*a* and 36*b* of banjo valves 34 and 36 by a common arm 45 for providing substantially simultaneous operation thereof. Block 42 includes a pair of valve seats 42*a* and a horizontal water channel 46*a* and a horizontal syrup channel 47*a*. Channels 46*a* and 47*a* intersect with and are in fluid communication with vertical channels 46*b* and 47*b*, respectively. Water channel 46*b* communicates with a diffuser retaining cavity 48, a syrup channel 47*b* terminates in a threaded cavity 49. A plurality of teeth 50 extend downwardly around a circular perimeter of cavity 48. A nozzle central portion 51 includes an outer tapered water flow surface 51*a*, top tapered shoulder area 51*b*, and a threaded attachment end portion 51*c*. Central portion 51 includes a syrup channel 52 extending therethrough in fluid communication with a plurality of syrup dispensing channels 52*a* extending substantially transverse to the extension of channel 52. Channels 52*a* terminate with syrup release orifices 52*b*. Nozzle central portion 51 also includes an attachment and 53. Threaded end 51*c* provides for threaded engagement of central portion 51 in threaded cavity 49. A diffuser plate 54 is held within cavity 48 between the shoulder 51*b* of central portion 51 and the block 42. Diffuser plate 54 is preferably threadably engageable with threaded portion 51*c* of central nozzle flow portion 51 and includes a plurality of orifices 54*a*. Nozzle exterior housing 55 includes sidewalls 55*a*, a circular opening 55*b*, and a plurality of beverage release orifices 56. Orifices 56 are defined by a plurality of webs 57. As seen in FIG. 9, nozzle outer housing 55 is secured to central nozzle portion 51 by press fitting of end 53 within opening 55*b*. Thus, after such press fitting, or other such secure assembly means, central portion 51 and outer housing nozzle portion 55 are essentially an integral singular piece. Housing 55 also includes a top perimeter edge 55*c* that lies closely adjacent an exterior surface 59 of block 42 when housing 55 and central portion 51 are secured thereto. Surface 59 has external horizontal marking lines 59*a*, and a ring or spacer 59*b* can be removably or fixedly secured around surface 59**.

Figure 10:
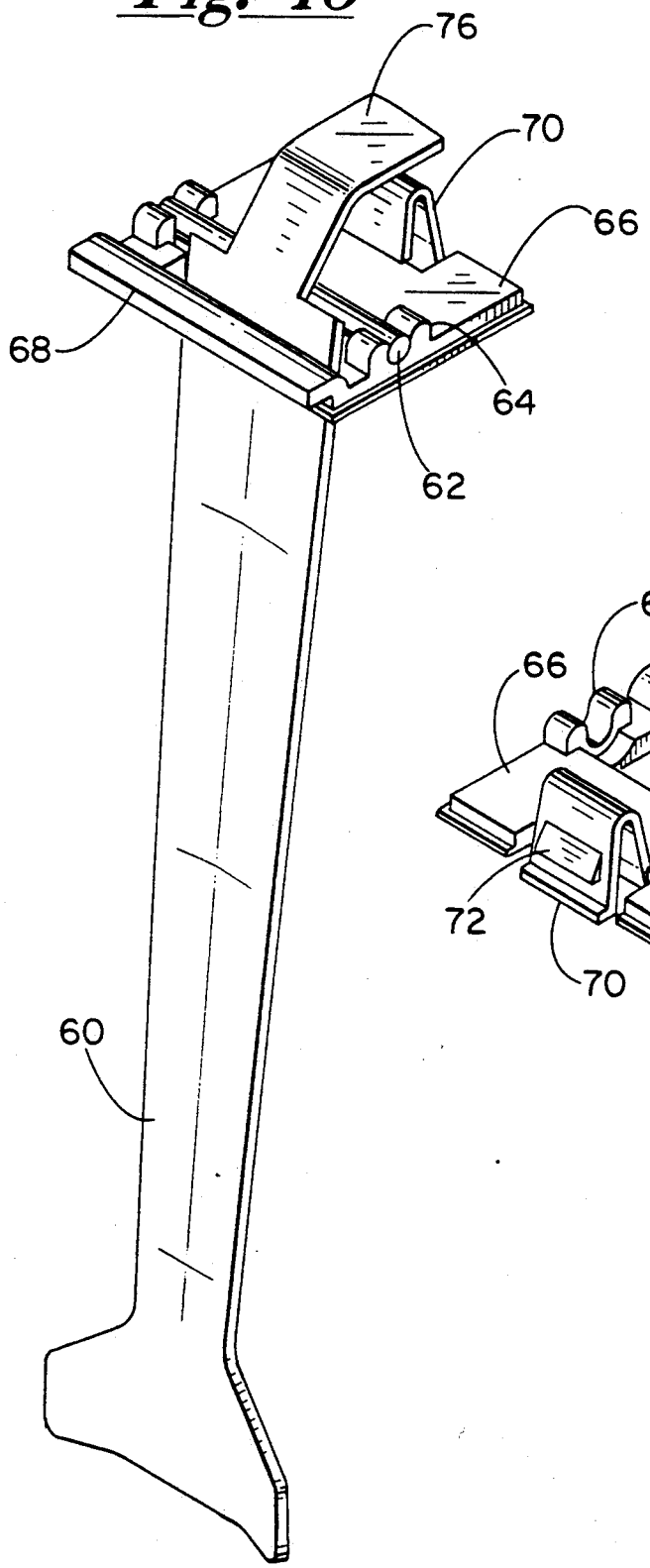
FIG. 10 shows an enlarged detail perspective view of the lever arm and snap support.
Figure 11:
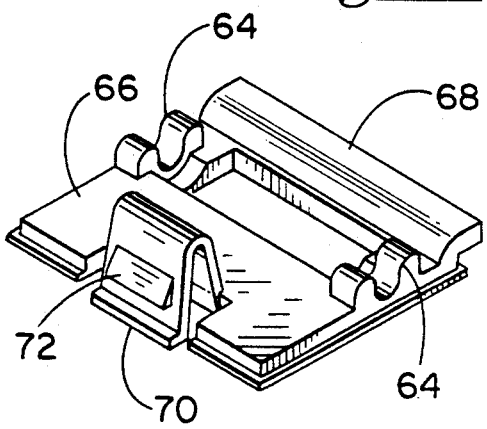
FIG. 11 shows an enlarged rear perspective view of the lever arm snap support.

As seen in FIGS. 10 and 11, valve 10 includes an actuating lever 60 pivotally suspended on a pin 62 extending between a pair of pin retaining clips 64 of a lever support 66. Lever support 66 includes a lip 68 on one end thereof and a live hinge 70 opposite therefrom. Hinge 70 has a stop protrusion 72 and a manually operable end 74. Lever 60 includes an end 76 for operating a micro-switch 78, show in dashed lines, which in turn, operates solenoid 44. Switch 78 is preferably mounted to block 12 in the area between tubes 22, 24, 30 and 32.

Figure 1:
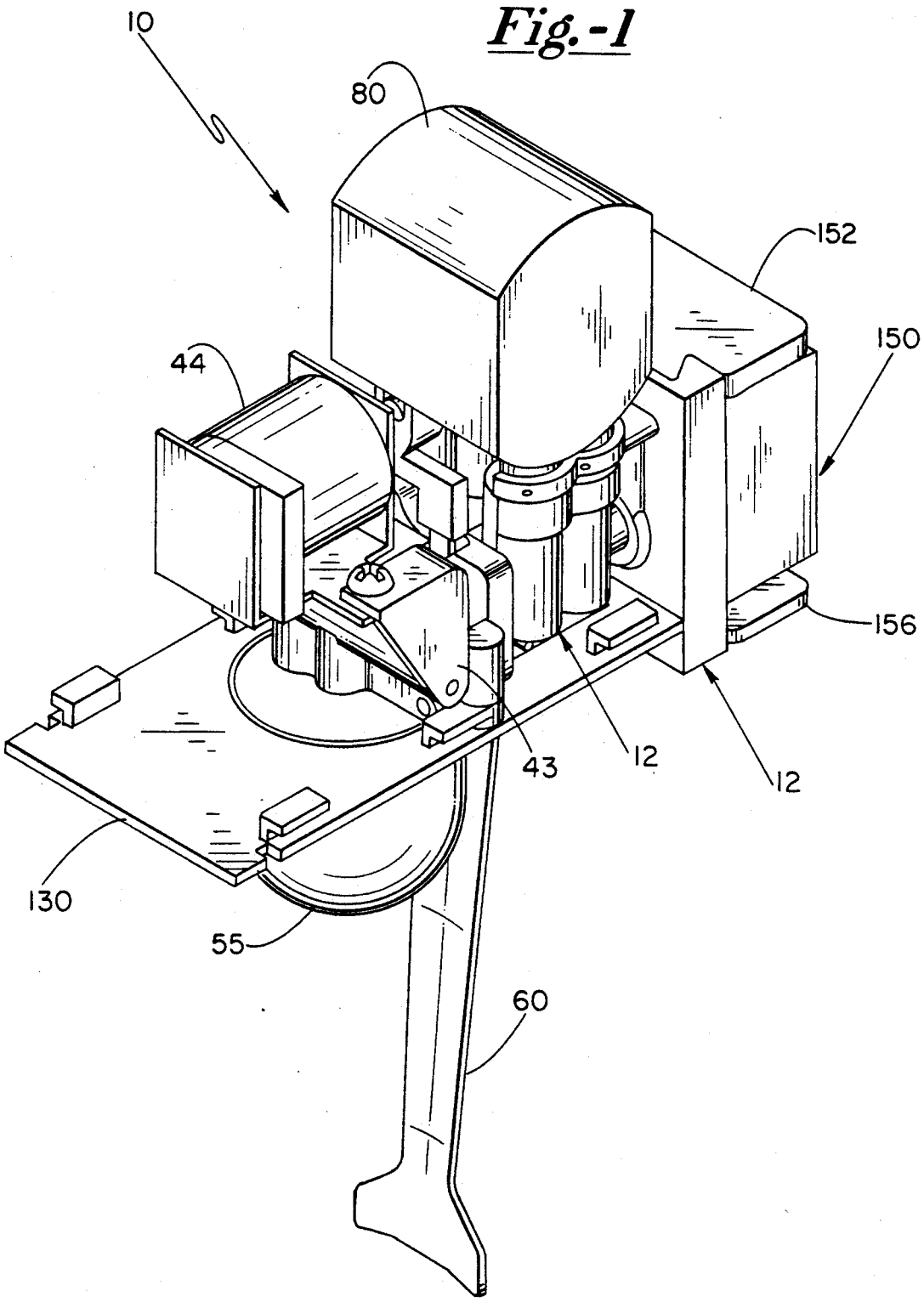
FIG. 1 shows a perspective view of the valve of the present invention with a brix control module secured thereto.
Figure 2:
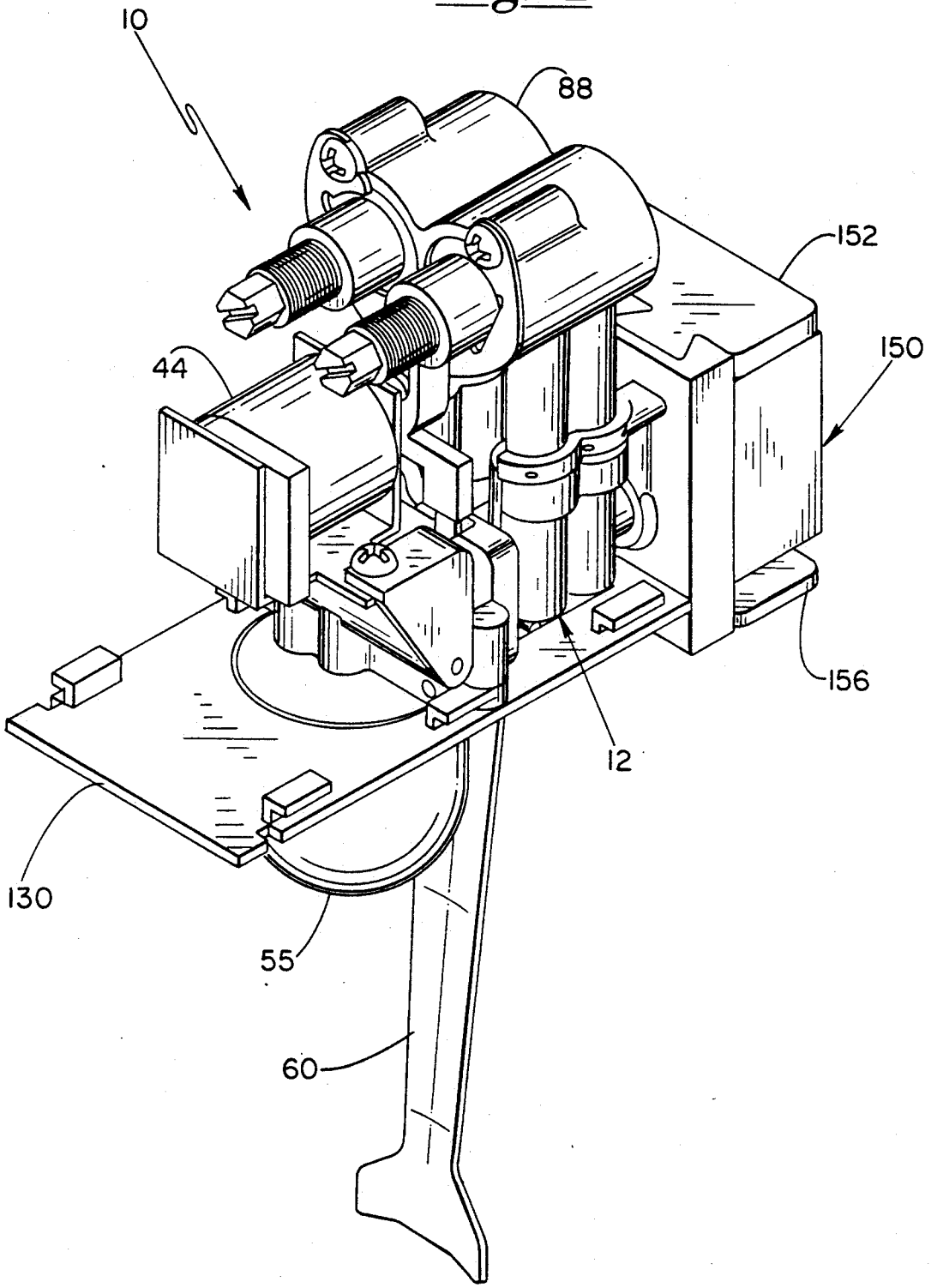
FIG. 2 shows a perspective view of the valve of the present invention with a spring biased piston type flow control module secured thereto.
Figure 18:
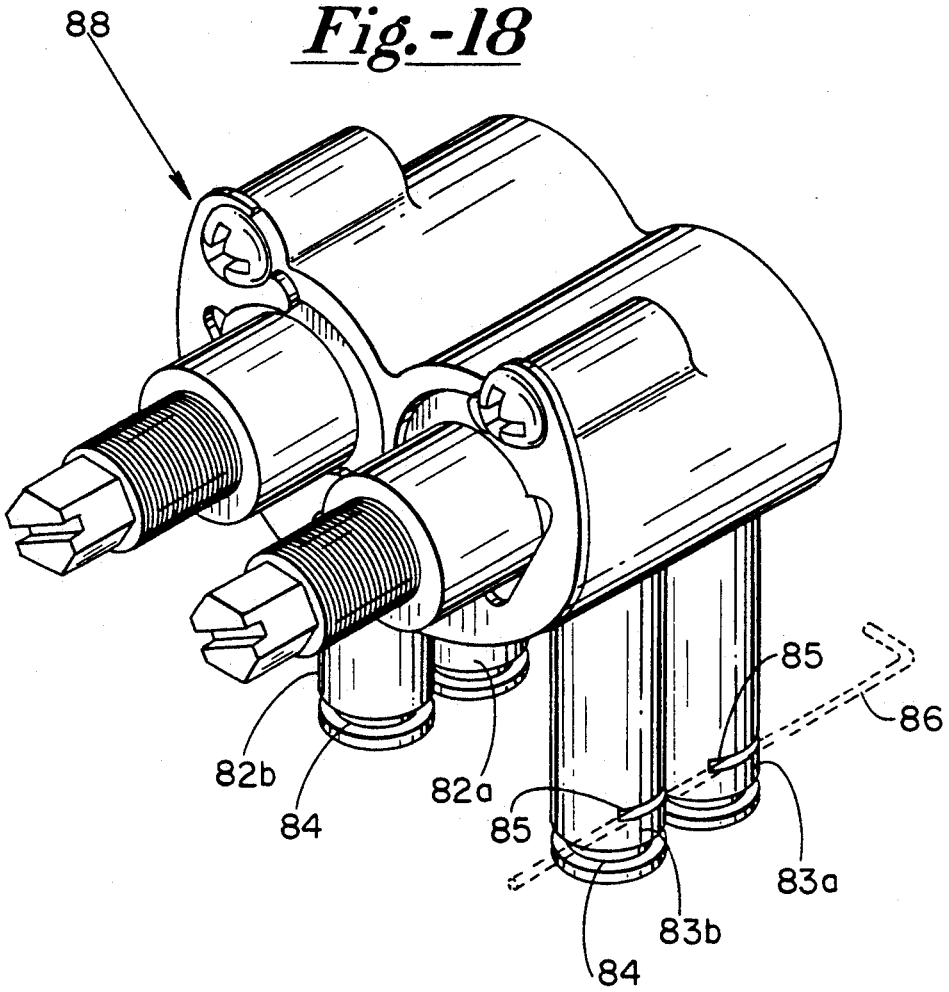
FIG. 18 shows an enlarged detail view of a flow control for use with the present invention.
Figure 19:
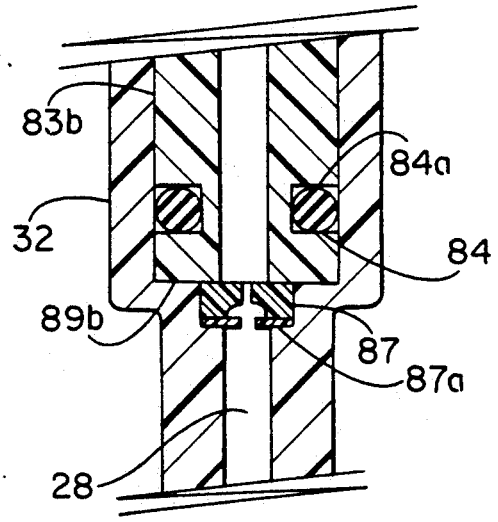
FIG. 19 shows an enlarged cross-sectional view of a flow control leg inserted into a corresponding channel of the valve main body.
Figure 20:
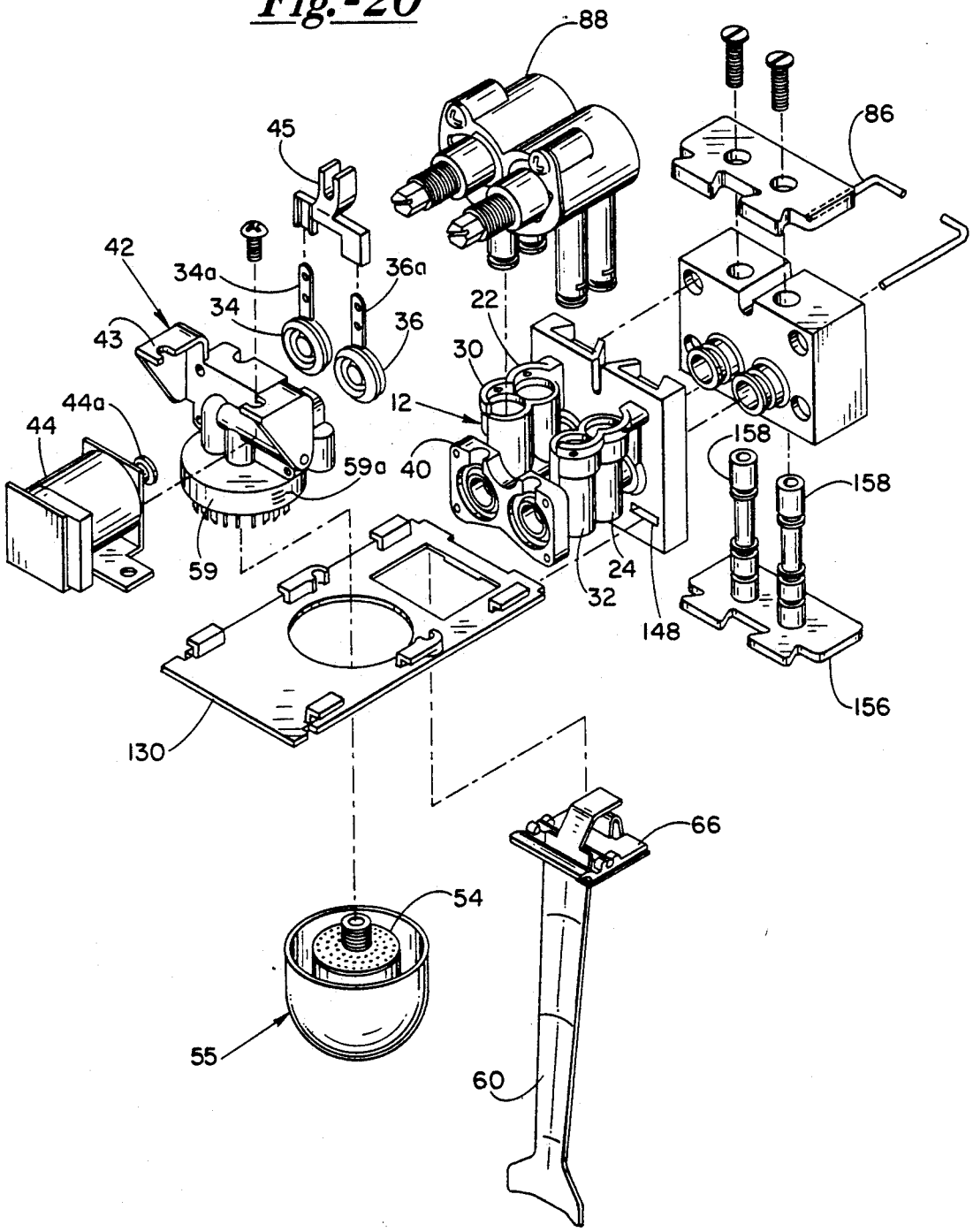
FIG. 20 shows an exploded view of the present invention.

As seen by again referring to FIGS. 1 and 2, and to FIGS. 18, 19 and 20, main body portion 12 can receive a brix control 80. A control in conformance with control 80 is seen in co-pending application, Ser. No. 628,818, now U.S. Pat. No. 5,156,301, is incorporated herein by reference, and as described in U.S. Pat. No. 5,012,837 to Zepp, which patent is also incorporated herein by reference. Brix control 80 is of an elliptical gear type which provides for an automatic and constant ratio between the syrup and liquid beverage components wherein such beverage components are pumped by the rotation of linked gears sets. Control 80 includes housing ends 81*a* and 81*b*, each having a pair of legs 82*a* and 82*b*, and 83*a* and 83*b*, respectively for cooperative insertion into tubes 22 and 24, and 30 and 32 respectively of main body portion 12. Legs 82*a* and 82*b* provide for flow into and out of control 80 of carbonated water and legs 83*a* and 83*b* provide for the flow into and out of control 80 of the syrup portion of the beverage. Legs 82*a* and 82*b* and 83*a* and 83*b* include annular grooves 84 for retaining o-rings 84*a* that provide for sealing with the interior surfaces of channels 22, 24, 30 and 32. When inserted in body 12, the ends of 82*a*, 82*b*, 83*a* and 83*b* abut against annular shoulders 84*b*. Legs 82*a*, 82*b*, 83*a* and 83*b* also include indents 85 immediately above grooves 84. Indents 85 allow for cooperation with a pair of pins 86. Each pin 86 is releasably insertable into valve body 12 through holes 86*a* formed therein, wherein they extend there through and into and cooperate with indents 85 for securing of control 80 to valve body 12. When using control 80, a flow control means such as an elastomeric flow control washer 87 can be located in syrup channel 32. As is known in the art the use of a rigid washer 87*a* is preferred in order to obtain maximum flow washer performance. The output of carbonated water and syrup from control 80 is dependent upon the rotation rate of the gears thereof which rate is a function of the pressure of the carbonated water and syrup delivered to control 80. Thus, such a flow control means can be of value to maintain the output flow rate of control 80 at a relatively constant rate even if variations of pressure in the syrup or carbonated water delivery lines are experienced. Use of washer 87 in the syrup line is preferred as variation in delivery line syrup pressure is typically greater on a percentage basis than is that of the carbonated water. It will be appreciated by those of skill that, as the syrup and carbonated water gears of control 80 are rotationally linked control of the rotation of the syrup gears will control the rotation of the water gears and vice-versa. As seen in FIG. 2, a flow control 88 is secured to main valve body 12. Flow control 88 includes a body 89 having the same legs 82*a* and 82*b*, and 83*a* and 83*b* and attachment means as with control 80 for permitting securing thereof to valve body 12. Control 88 is a flow control of the piston type, well known in the art, including spring biased pistons, not shown, that provide for regulating the flow rate of the beverage components and providing for ratioing thereof.

Figure 15:
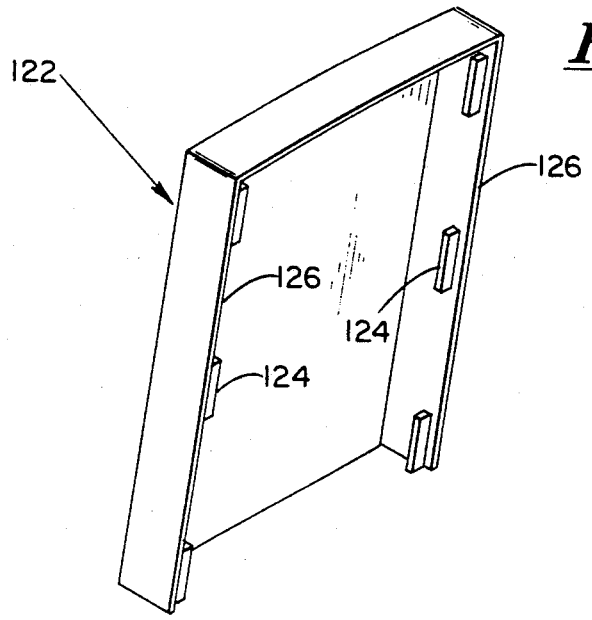
FIG. 15 shows a perspective view of the front access cover of the present invention.
Figure 16:
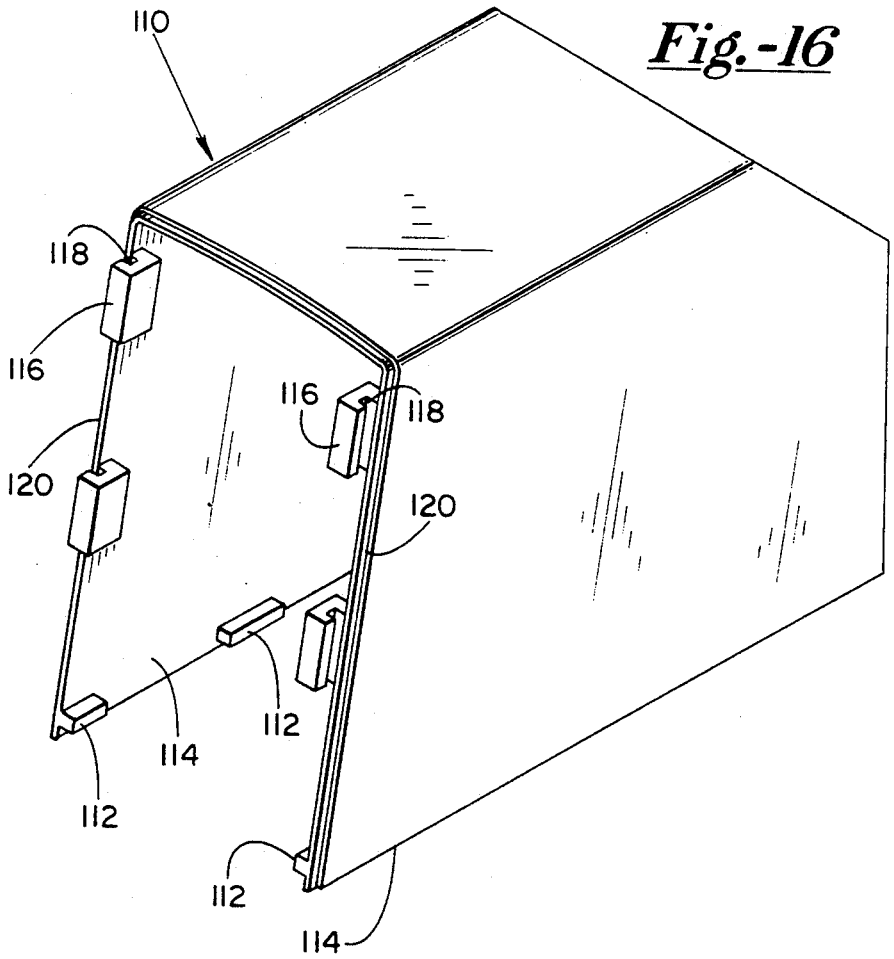
FIG. 16 shows a perspective view of main valve cover housing portion.
Figure 17:
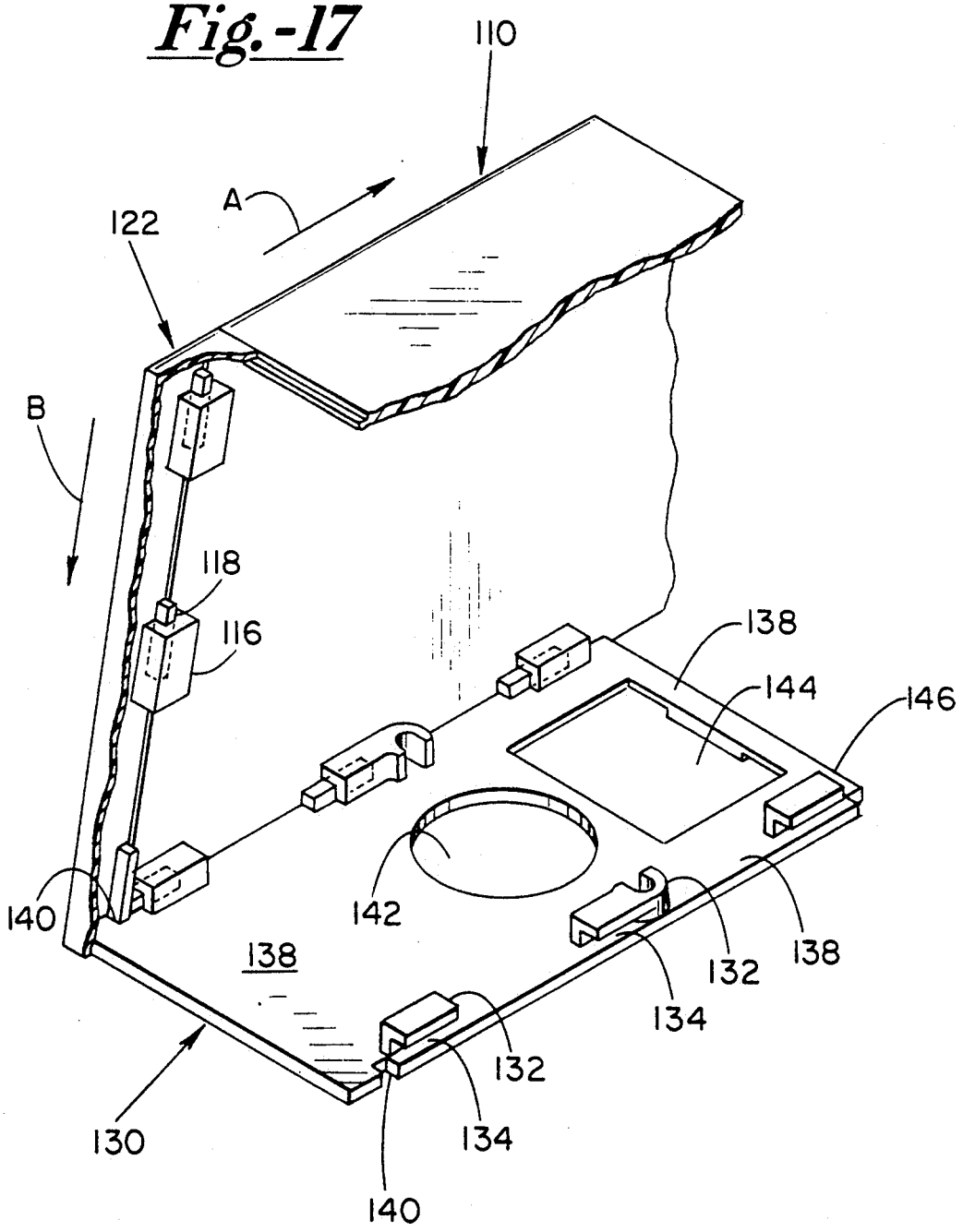
FIG. 17 shows a perspective view of the valve base, access cover and main valve cover housing portion in partial cross section.

Referring to FIGS. 15, 16 and 17, the present invention includes a main housing 110 and a plurality of tabs 112 extending from the opposed bottom edges 114 thereof, and includes retaining means 116 having grooves 118 integral therewith and extending from opposite front sides 120 thereof. A front access cover 122 includes a plurality of tabs 124 extending inwardly from opposite edges 126 thereof. A base plate 130 includes retaining means 132 defining slots 134 integral with an extending from top surface 136 thereof along opposite side edges 138 thereof. Base 130 includes a pair of notches 140 and a nozzle hole 142 and a lever retaining opening 144. Base 130 further includes inserting tabs 146 for inserting cooperation with slots 148 of block 12.

Figure 12:
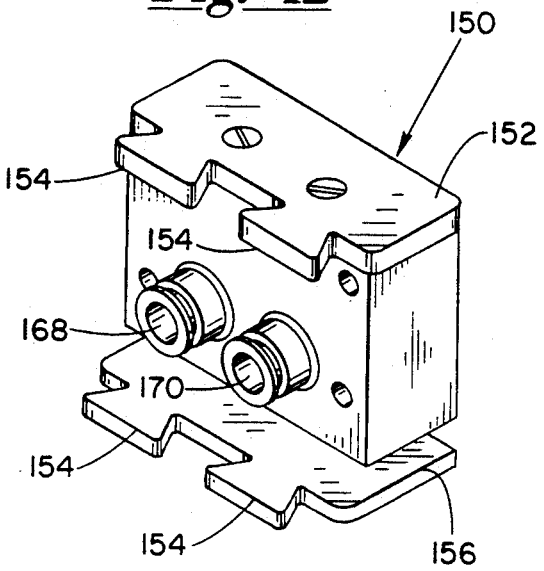
FIG. 12 shows a front perspective view of the quick disconnect mounting.
Figure 13:
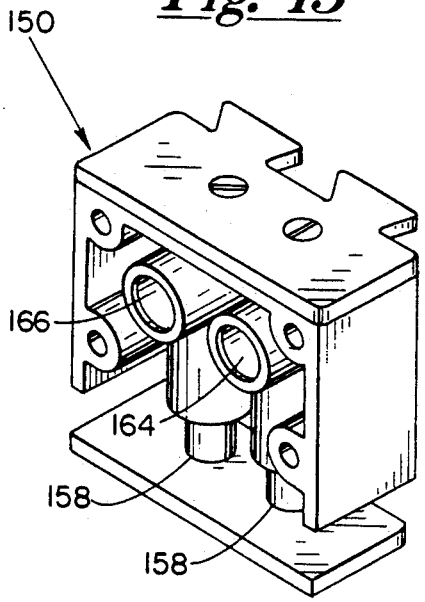
FIG. 13 shows a rear perspective view of the quick disconnect mounting.
Figure 14:
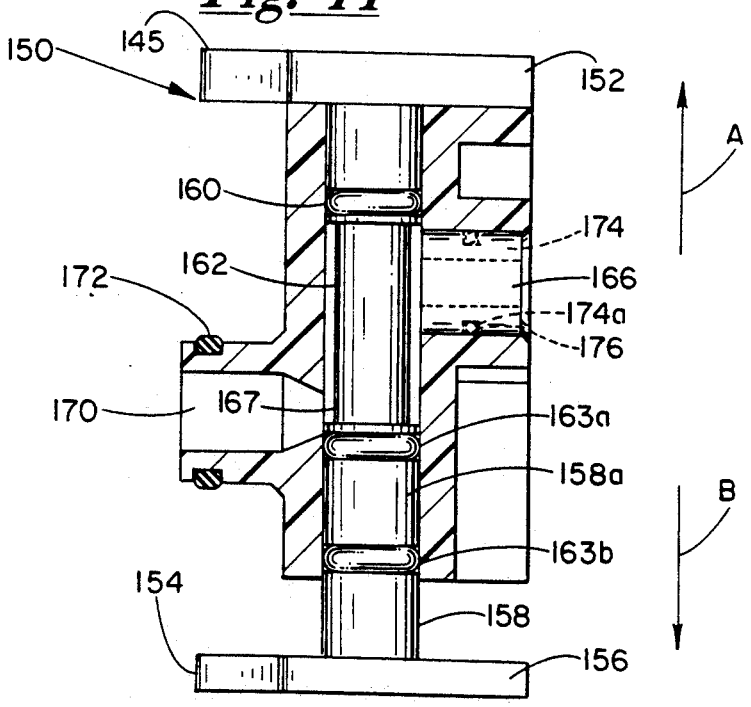
FIG. 14 shows a cross-sectional view along lines 14—14 of FIG. 12.

As seen in FIGS. 12, 13 and 14, the present invention includes a quick disconnect mounting block 150. Block 150 has a top plate 152 having a trapezoidially shaped locking tabs 154 and a bottom locking plate 156 also having a trapezoidially shaped locking tabs 154. Plates 152 and 156 are secured to a pair of shafts 158 having upper o-rings 160, narrowed annular areas 162, and lower o-rings 163*a* and 163*b* on either side of shaft portions 158*a*. Block 150 includes a water inlet port 164 and a syrup inlet port 166, and corresponding water outlet ports 168 and syrup outlet port 170. Ports 168 and 170 each have an orifice 167 providing fluid communication to annular areas 162, and the diameters of orifices 167 are less than the thickness of top plate 152. Ports 168 and 170 further include o-rings 172 for providing releasable sealing engagement thereof with channels 18 and 20 of main body portion 12. Bushings 174, having annular grooves 174*a* for retaining o-rings 176 and are optionally press-fittable within inlets 164 and 166.

In operation, it can be appreciated that controls 80 and 88 can be easily and quickly interchanged from body 12 wherein, after the removal of disconnect 150, pins 86 are pulled from body 12 followed by the disengaging and re-insertion of a further module, followed by the re-insertion of pins 86. Thus, for example, brix controls such as control 80 can be manufactured to provide for different beverage ratios and, therefore, can allow for such changes in beverage ratio while permitting the use of the same valve body. Similarly, different flow controls can be quickly and easily substituted which provide for a range of flow rates in the same valve body. Thus, the valve body of the present invention and the corresponding brix or flow controls are designed to permit quick interchangeability so that a particular valve is not limited to a particular narrow range of operating characteristics. Therefore, it will be understood that such modular approach is achieved by control units having identical connecting and locking means for cooperating with and securing to receiving means of the valve body.

The nozzle of the present invention provides for an adjustability thereof so as to optimize its operation at different beverage dispensing flow rates. Central portion 51 and outer housing 55 are an integral piece after assembly. It can be seen that by grasping the outer surface 55*a* of housing 55 the central portion, along with housing 55, can be rotated by threading central portion 51 into and out of cavity 49. It can be understood that the size of openings 58 can therefore be regulated by threading central portion 51 into or out of cavity 49. It can be appreciated by those of skill that as central portion 51 is threaded into cavity 49, water flow orifices 58 decrease in size and thereby increase the back pressure acting on the carbonated water as it flows therethrough. Without sufficient back pressure, the carbonated water has a tendency to flow through channel 46*b* and into cavity 48, but not flow evenly over the surface of diffuser plate 54 and through all of the orifices 54*a* thereof. Instead, the water may flow through a small portion of diffuser plate 54 and then down a small portion of shoulder 51*b* and outer surface 51*a* of central portion 51. Ideally, the carbonated water should flow in a laminar and even fashion down the entire surface 51*a*. To accomplish such flow, for example, valve 10 is operated to dispense beverage whereby outer housing 50 can then be grasped to rotate central portion 51 so as to reduce the size of orifices 58 to a point where the flow becomes even over surface 51*a*, as is indicated by even flow of beverage from orifices 56. It can be appreciated that outer housing 55 provides a means for such adjustment without necessitating physical contact with central portion 51 or any of the surfaces over or through which the beverage flows. The present invention thereby provides for the interchanging of flow/brix modules for changing the flow and/or brix control rate, along with an adjustable nozzle to optimize the performance thereof with respect to such varying flow rates. The flow of carbonated water along tapered surface 51*a* serves to slowly decelerate the flow of the carbonated water, thereby minimizing breakout of carbon dioxide gas and the resultant loss of carbonation thereof. Moreover, it can be seen that the carbonated water does not mix with the syrup until it has reached the bottom of portion 51, wherein the syrup exits orifices 52*b*, further maximizing carbonation retention. So that central portion 51 is retained relatively firmly in the particular desired position, class four interference fit threads are used in cavity 49 and threaded end 51*c*. To provide for easy visual determination of optimum flow rate outer housing 55 can be made of a clear plastic material. Also, nozzle 50 can be made in a pre-set form wherein orifices 58 are maintained of a predetermined size, where, for example, a single flow rate will be encountered. Thus, knowing the optimum size of orifices 58, central portion 51 can be manufactured to lock or fit into a particular position with respect to block 42 that provides for the desired size of orifices 58. Such can be accomplished by having end 51*c* bottom out in cavity 49 at the desired position. As an intermediate approach, nozzle 50 can be made settable to two or more pre-determined positions to provide for adjustment to two or more matching flow rates. Such setting can be provided where markings, 59*a*, on surface 59, indicate the desired position when even with housing portion perimeter edge 55*c*. As an alternative, spacing ring 59*b* can be sized so that edge 55*c* contacts therewith at the desired setting. Thus, a variety of spacers 59*b* can be interchanged to provide for a desired setting wherein housing 55 and central portion 51 are screwed into cavity 49 to the point where edge 55*c* and the spacer 59*b* contact.

It can be understood that lever 60 is quickly removeable from valve 10. Specifically, lever support 66 is retained within base plate opening 144 wherein lip 68 lies along one edge thereof and hinge 70 interacts with an opposite edge thereof. The removal of lever 60 involves the operating of hinge 70 so that protrusion 72 is clear of the associated perimeter edge of opening 144, thereby allowing lever 60, along with support 66, to be removed from base plate 130. If lever 60 needs replacement, it can be placed on support 66 by removing and replacing pin 62 and re-inserting lever support within the hole 144.

Housing 110, access cover 122 and base plate 130 provide for covering and protection of the valve components, such as block 12 and 42, and solenoid 45. The advantage presented by housing 110, access cover 122 and base plate 130 is that they all include retaining means that eliminate the need for separate retaining clips or screws. Thus, the components of valve 10 can be easily accessed without the need for tools to remove the housing, such as the use of a screwdriver, and so forth. In particular, base plate 130 is first secured to block 12 by the insertion of tabs 146 into associated slots 148. The main housing 110 is then moved in the direction of arrow A in FIG. 17 wherein the tabs 12 slide within retaining means 132. All three pieces: base plate 130, housing 110 and access cover 120 are then locked in place by the sliding of access cover 120 in the direction of arrow B of FIG. 17 wherein the tabs 124 thereof slide within retaining means 116 of housing 110. In addition, it can be seen that when fully locked in place, the bottom tabs 124 of cover 122 insert into slots 134 of base plate 130.

Figure 3:
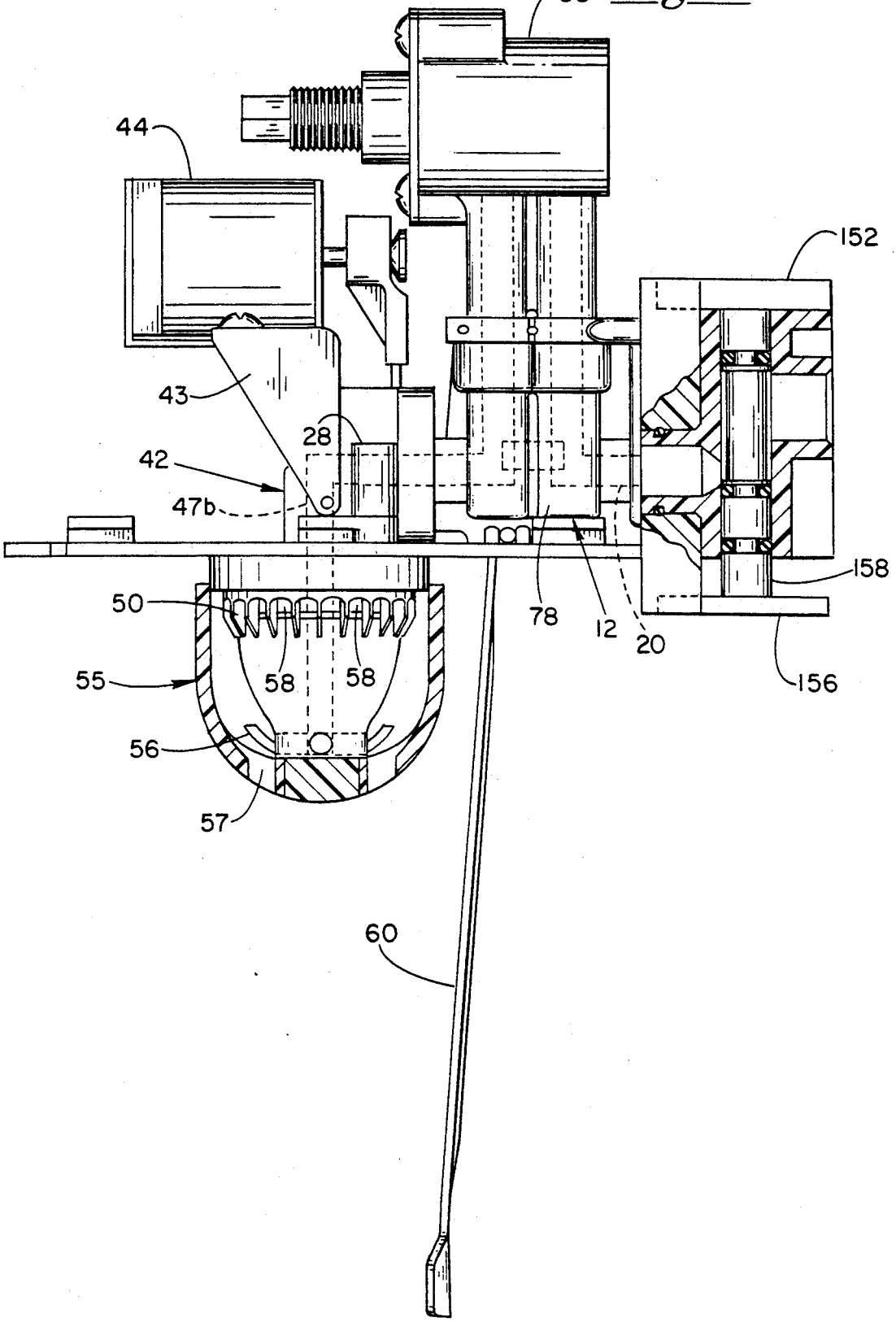
FIG. 3 shows a side plan partial cross-sectional view of the valve of the present invention.
Figure 7:
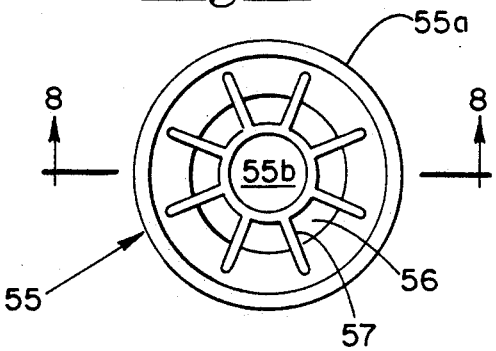
FIG. 7 shows a top plan view of the nozzle outer housing portion.
Figure 8:
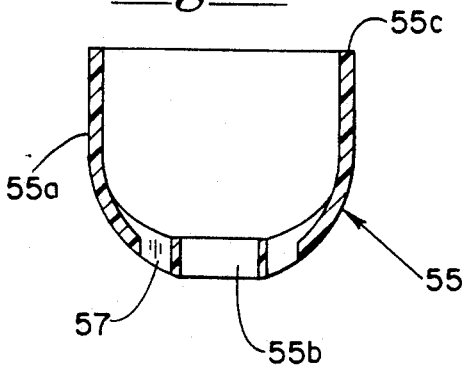
FIG. 8 shows a cross-sectional view along lines 8—8 of FIG. 7.

As is known in the art, a quick disconnect provides for securing to and removal of the valve body to a dispenser having sources of syrup and carbonated water. In the present invention, disconnect block 150 is connected to such a beverage dispenser or tower, and provides for the quick securing to and release therefrom of valve 10. In particular, plates 152 and 156 are moveable in an up and down manner, as indicated by arrows A and B respectively of FIG. 14. In the locked position, as seen in FIG. 3, tabs 154 are retained within pockets 14 and 16. A particular advantage of such a locking approach concerns the securing of valve 10 to disconnect 150 at the four corners thereof as represented by pockets 14 and 16. This approach wherein the valve and the quick disconnect block are secured at both ends at both the top and bottom thereof, provides for a very secure positive fit there between with little or no unwanted play or the like that can cause wear or leaks. Also, annular areas 162 of shafts 158 provide for fluid communication between inlet and outlet ports 164 and 168, and syrup inlet and outlet ports 166 and 170. Thus, shafts 158 and annular grooves 162 form barrel valves which are open when tabs 154 are held within pockets 14 and 16. To disconnect valve body 12 from disconnect block 150, tabs or plates 152 and 156 are operated in a direction of arrow A in FIG. 14 so that the orifices 167 of water outlet port 168 and syrup outlet port 170 are blocked by shaft portions 158*a*. It will be understood that as the diameter of orifices 167 is less than the thickness of plate 152, valve 10 can not be removed from disconnect body 150 prior to orifices 170 being fully blocked by shaft portions 158*a*. In this manner, accidental discharges of water and/or syrup are prevented. Cylindrical bushings, 174, can be inserted into inlets 164 and 166 to provide for adapting block 150 to the variously sized feeder lines as is found in the different types of beverage dispensing equipment to which disconnect 150 is mounted. The quick disconnect of the present invention reduces the number of parts required by other such disconnects, seen in the prior art, and provides a very positive locking means for assuring retention of the valve.

What is claimed is:

1. A quick disconnect for a liquid dispensing valve, comprising:

a disconnect body for securing to a liquid dispenser and to a source of the liquid to be dispensed, the disconnect body having a liquid inlet for providing fluid communication to the source of liquid and an outlet releasably connectable with the dispensing valve for providing communication of the liquid from the disconnect body to the dispensing valve, a shaft extending through a bore in the disconnect body between a top end and a bottom end thereof in a direction transverse to the extension of the liquid inlet and liquid outlet, and the shaft having a smaller diameter portion along a segment thereof for defining an annular groove between the shaft and the bore in the disconnect body, the shaft also having a blocking portion and the shaft operable to alternately position the annular groove or the blocking portion between the liquid inlet and liquid outlet for permitting fluid communication and preventing fluid communication respectively between the liquid inlet and liquid outlet, a top plate and a bottom plate, each plate having one or more locking tabs for providing locking cooperation with one or more corresponding tab receiving pockets in the dispensing valve, and the plates secured to opposite ends of the shaft so that when the shaft is positioned to permit fluid communication between the liquid inlet and liquid outlet the one or more locking tabs of the plates cooperate with the one or more corresponding tab receiving pockets for securing the valve to the disconnect body, and so that when fluid communication between the liquid inlet and liquid outlet is prevented the one or more locking tabs are not in locking cooperation with the one or more corresponding tab receiving pockets.

2. A beverage dispensing valve having a quick disconnect, comprising:

a disconnect body for securing to a valve support structure, the disconnect body having a liquid inlet for providing releasable and sealable fluid connection with a fluid fitting on the support structure, the fitting connected to a source of a liquid beverage component, and the disconnect body having a liquid outlet for releasable and sealable connection with a dispensing valve inlet, a shaft extending through a bore in the disconnect body, the bore extending through the disconnect body between a top end and a bottom end thereof in a direction transverse to the extension of the liquid inlet and liquid outlet, and the shaft having a smaller diameter portion along a segment thereof for defining an annular groove between the shaft and the bore in the disconnect body, the shaft also having a blocking portion, and the shaft slideably mounted in the bore for movement to a first position wherein the annular groove is positioned between the liquid inlet and liquid outlet for permitting fluid communication there between, and the shaft movable to a second position wherein the blocking portion is positioned between the liquid inlet and liquid outlet for preventing fluid communication there between, a top plate, the top plate secured to a first end of the shaft and having one or more top locking tabs for providing locking cooperation with one or more corresponding top tab receiving pockets in the dispensing valve for securing the disconnect body to the beverage dispensing valve when the shaft is in the first position, and the one or more top locking tabs removed from the one or more corresponding top tab receiving pockets when the shaft is in the second position so that the beverage dispensing valve is removable from the disconnect body.

3. The beverage dispensing valve as defined in claim 2, and further including a bottom plate, the bottom plate secured to a second end of the shaft and having one or more bottom locking tabs for providing locking cooperation with one or more corresponding bottom tab receiving pockets in the dispensing valve for further securing the disconnect body to the beverage dispensing valve when the shaft is in the first position, and the one or more bottom locking tabs removed from the one or more corresponding bottom tab receiving pockets when the shaft is in the second position so that the beverage dispensing valve is removable from the disconnect body.

4. The beverage dispensing valve as defined in claim 3, and the one or more bottom locking tabs being trapezoidal in shape and the one or more corresponding bottom tab receiving pockets complementary in shape for receiving the one or more bottom tabs therein.

5. The beverage dispensing valve as defined in claim 2, and the one or more top locking tabs being trapezoidal in shape and the one or more corresponding top tab receiving pockets complementary in shape for receiving the one or more top tabs therein.

6. A beverage dispensing valve having a quick disconnect, comprising:

a disconnect body for securing to a valve support structure, the disconnect body having first and second liquid inlets for providing releasable and sealable fluid connection with first and second fluid fittings on the support structure, the support structure fittings connected to sources of liquid beverage components, and the disconnect body having first and second liquid outlets for releasable and sealable connection with first and second dispensing valve inlets, first and second shafts extending through first and second bores in the disconnect body, the bores extending through the disconnect body between a top end and a bottom end thereof in a direction transverse to the extension of the liquid inlets and liquid outlets, and the shafts each having a smaller diameter portion along a segment thereof for defining first and second annular grooves between the respective shaft and bore thereof and each shaft also having a blocking portion, and the shafts slideably mounted in their respective bores for movement to a first position wherein the first and second annular grooves are positioned between their respective first and second inlets and outlets for permitting fluid communication there between, and the shafts movable to a second position wherein each blocking portion between the respective inlet and outlet for preventing fluid communication there between, a top plate, the top plate secured to first ends of the shafts and having one or more top locking tabs for providing locking cooperation with one or more corresponding top tab receiving pockets in the dispensing valve for securing the disconnect body to the beverage dispensing valve when the shafts are in the first position, and the one or more top locking tabs removed from the one or more corresponding top tab receiving pockets when the shafts are in the second position so that the beverage dispensing valve is removable from the disconnect body.

7. The beverage dispensing valve as defined in claim 6, and further including a bottom plate, the bottom plate secured to second ends of the shafts and having one or more bottom locking tabs for providing locking cooperation with one or more corresponding bottom tab receiving pockets in the dispensing valve for further securing the disconnect body to the beverage dispensing valve when the shafts are in the first position, and the one or more bottom locking tabs removed from the one or more corresponding bottom tab receiving pockets when the shafts are in the second position so that the beverage dispensing valve is removable from the disconnect body.

8. The beverage dispensing valve as defined in claim 7, and the one or more top and bottom locking tabs trapezoidal in shape and the one or more corresponding top and bottom tab receiving pockets complementary in shape for receiving the top and bottom tabs respectively therein.

9. The beverage dispensing valve as defined in claim 6, and the one or more top locking tabs trapezoidal in shape and the one or more corresponding top tab receiving pockets complementary in shape for receiving the one or more top tabs therein.

10. A quick disconnect for a beverage dispensing valve, comprising:

a disconnect body for securing to a valve support structure, the disconnect body having first and second liquid inlets for providing releasable and sealable fluid connection with first and second fluid fittings on the support structure, the support structure fittings connected to sources of liquid beverage components, and the disconnect body having first and second liquid outlets for releasable and sealable connection with first and second dispensing valve inlets, first and second shafts extending through first and second bores in the disconnect body, the bores extending through the disconnect body between a top end and a bottom end thereof in a direction transverse to the extension of the liquid inlets and liquid outlets, and the shafts each having a smaller diameter portion along a segment thereof for defining first and second annular grooves between the respective shaft and bore thereof and each shaft also having a blocking portion, and the shafts slideably mounted in their respective bores for movement to a first position wherein the first and second annular grooves are positioned between their respective first and second inlets and outlets for permitting fluid communication there between, and the shafts movable to a second position wherein each blocking portion is positioned between the respective inlet and outlet for preventing fluid communication there between, a top plate, the top plate secured to first ends of the shafts and having one or more top locking tabs for providing locking cooperation with one or more corresponding top tab receiving pockets in the dispensing valve for securing the disconnect body to the beverage dispensing valve when the shafts are in the first position, and the one or more top locking tabs removed from the one or more corresponding top tab receiving pockets when the shafts are in the second position so that the beverage dispensing valve is removable from the disconnect body, and a bottom plate, the bottom plate secured to second ends of the shafts and having one or more bottom locking tabs for providing locking cooperation with one or more corresponding bottom tab receiving pockets in the dispensing valve for further securing the disconnect body to the beverage dispensing valve when the shafts are in the first position, and the one or more bottom locking tabs removed from the one or more corresponding bottom tab receiving pockets when the shafts are in the second position so that the beverage dispensing valve is removable from the disconnect body.

11. The beverage dispensing valve as defined in claim 10, and the one or more top and bottom locking tabs trapezoidal in shape and the one or more corresponding top and bottom tab receiving pockets complementary in shape for securely receiving the one or more top and bottom tabs respectively therein.

* * * * *